US008731448B2

(12) United States Patent
Echigo

(10) Patent No.: US 8,731,448 B2
(45) Date of Patent: May 20, 2014

(54) IMAGE FORMING APPARATUS INCLUDING A SECONDARY TRANSFER NIP FORMED WITH A MOVABLE ROLLER

(75) Inventor: Katsuhiro Echigo, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 119 days.

(21) Appl. No.: 13/354,910

(22) Filed: Jan. 20, 2012

(65) Prior Publication Data

US 2012/0189358 A1 Jul. 26, 2012

(30) Foreign Application Priority Data

Jan. 26, 2011 (JP) ..... 2011-014012
Feb. 4, 2011 (JP) ..... 2011-022809

(51) Int. Cl.
*G03G 15/01* (2006.01)
*G03G 15/20* (2006.01)

(52) U.S. Cl.
USPC ..... 399/302; 399/313

(58) Field of Classification Search
USPC ..... 399/302, 308, 313
See application file for complete search history.

(56) References Cited

U.S. PATENT DOCUMENTS 7,546,074 B2 6/2009 Oyama et al.
8,081,913 B2 12/2011 Oyama et al.
2006/0209151 A1 9/2006 Tamiya et al.
2008/0213010 A1 9/2008 Oyama et al.
2009/0324306 A1 12/2009 Echigo et al.
2010/0046991 A1 * 2/2010 Hodoshima et al. ..... 399/313
2010/0142985 A1 * 6/2010 Minbe et al. ..... 399/66

FOREIGN PATENT DOCUMENTS

JP 2007-316427 12/2007
JP 2008-96557 4/2008
JP 2008-262038 10/2008
JP 2008-281933 11/2008
JP 2010-54969 3/2010

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

An image forming apparatus including an endless intermediate transfer member stretched over a plurality of rollers; a first biasing member; a secondary transfer roller to be pressed against a surface of the intermediate transfer member by the first biasing member; an opposed roller disposed opposite the secondary transfer roller to thus form a secondary transfer nip at which the toner image carried on the intermediate transfer member is transferred onto a recording medium; and a second biasing member to bias the opposed roller. The secondary transfer roller and the opposed roller are movable along a line connecting respective axes of the rollers and a pressure F2 applied by the first biasing member to the secondary transfer roller at the secondary transfer nip is greater than a pressure F1 applied to the opposed roller by the second biasing member at the secondary transfer nip.

10 Claims, 5 Drawing Sheets

IMAGE FORMING APPARATUS INCLUDING A SECONDARY TRANSFER NIP FORMED WITH A MOVABLE ROLLER

CROSS-REFERENCE TO RELATED APPLICATIONS

The present application claims priority from Japanese patent application numbers 2011-014012 and 2011-022809, filed on Jan. 26, 2011 and Feb. 4, 2011, respectively, the entire contents of which are incorporated by reference herein.

BACKGROUND OF THE INVENTION

1. Field of the Invention

The present invention relates to an image forming apparatus of an electrophotographic method such as a printer, a copier, a facsimile machine, and a multi-function apparatus having one or more capabilities of the above devices, and in particular to a secondary transfer device included in such an image forming apparatus.

2. Description of the Related Art

In an image forming apparatus employing the electrophotographic method and having an intermediate transfer member, in general, an electrophotographic image formed on an image carrier such as a photoreceptor is developed a toner image by a developing device; the toner image is once transferred from the image carrier to an intermediate transfer member such as an intermediate transfer belt; thereafter, the toner image on the intermediate transfer member is secondarily transferred to a recording medium such as a transfer sheet at a secondary transfer portion or nip formed of the intermediate transfer member and a secondary transfer roller and an opposed roller that sandwich the intermediate transfer member; and the toner image formed on the recording medium is fixed thereon by a fixing member with pressure and heat.

There is an acute demand for optimal toner image transfer to various recording media available in the market while maintaining good image quality across all media. However, currently commercially available recording media for use in the on-demand printing field typically have surfaces with various asperities therein, and such rough surfaces tend to adversely affect image quality.

One way to form an optimal image on such recording media involves improving the transferability of the toner image to the recording media by using greater pressure to press together the secondary transfer roller and the opposed roller forming the secondary transfer nip with the intermediate transfer member sandwiched in between.

However, increasing the nip pressure in the secondary transfer nip has a disadvantage in that, when a relatively thick sheet is passed through the secondary transfer nip set at a high pressure, fluctuation in the torque load on the intermediate transfer member greatly increases, which in turn causes the rotation speed of the intermediate transfer member to fluctuate. More specifically, the fluctuation in speed occurs in such a manner that, when a thick recording medium enters between the secondary transfer roller and the opposed roller sandwiching the intermediate transfer member, the load on the opposed roller greatly increases and the brakes are applied to the rotation speed of the intermediate transfer member. As a result, tension is given to the secondary transfer nip upstream that causes the intermediate transfer member to go slack. At the same time, the intermediate transfer member is stretched taut downstream, thus changing the rotation speed of the intermediate transfer member.

When image formation is to be performed on multiple sheets of recording media, while a previous toner image is being transferred to the recording medium at the secondary transfer nip, a subsequent image is primarily transferred to the intermediate transfer member at the primary transfer portion. In this case, when the speed of the intermediate transfer member changes due to the passage of the recording medium into the secondary transfer nip, the next toner image being primary transferred to the intermediate transfer member may acquire lateral bands as the recording medium enters the secondary transfer nip and the toner image is secondarily being transferred onto the recording medium. This phenomenon is called shock jitter. Accordingly, that the secondary transfer nip portion is applied with a high pressure to exert an optimal transferability to recording media with surface asperities may result in disadvantage that an optimal transferred image cannot be obtained in repeatedly printing thick sheets.

JP-2008-96557-A discloses a structure to reduce the torque load change of the intermediate transfer member in the secondary transfer nip. The same includes a first rotary member as an opposed roller, a transfer roller as a second rotary member to which biasing force to bias the opposed roller is given from a biasing means, and discloses a structure in which, when a recording medium is supplied between the first and second rollers, a rotary shaft of the transfer roller escapes in a direction different from the biasing direction of the biasing means so that a pushing-up force of the transfer roller which vertically shifts from the conveyance direction of the recording medium is reduced depending on the thickness of the sheet conveyed and the torque load change of the intermediate transfer member sandwiched by the transfer roller and the opposed roller can be reduced.

Even with the above-described configuration, however, it is difficult to simultaneously achieve both improvement in image transferability to recording media with surface asperities and reduction of shock jitter when the thick sheet enters the secondary transfer nip.

BRIEF SUMMARY OF THE INVENTION

The present invention provides an image forming apparatus capable of obtaining optimal toner image transferability to cardboard and various other types of relatively thick recording media with surface asperities and forming a quality image with reduced shock jitter when the thick sheet enters the secondary transfer nip portion.

Specifically, the present invention provides an image forming apparatus including an endless intermediate transfer member stretched over a plurality of rotatably driven rollers and configured to bear a toner image on a surface thereof; a first biasing member; a secondary transfer roller to be pressed against the surface of the intermediate transfer member by the first biasing member at a pressure F2; an opposed roller, being one of the plurality of rollers around which the intermediate transfer member is wound, disposed opposite the secondary transfer roller with the intermediate transfer member sandwiched between the opposed roller and the secondary transfer roller, the secondary transfer roller and the opposed roller together forming a secondary transfer nip with the sandwiched intermediate transfer member, at which the toner image carried on the intermediate transfer member is transferred onto a recording medium; and a second biasing member to bias the opposed roller toward a center of the secondary transfer roller at a pressure F1, the secondary transfer roller and the opposed roller being movable along a line connecting respective axes of the secondary transfer roller and the opposed roller, and the pressure F2 applied by the biasing member to the secondary transfer roller at the secondary transfer nip being greater than a pressure F1 applied to the opposed roller by the second biasing member at the secondary transfer nip.

These and other objects, features, and advantages of the present invention will become more readily apparent upon consideration of the following description of the preferred embodiments of the present invention when taken in conjunction with the accompanying drawings.

DETAILED DESCRIPTION OF THE INVENTION

Hereinafter, preferred embodiments of the present invention will now be described with reference to accompanying drawings.

Figure 1:
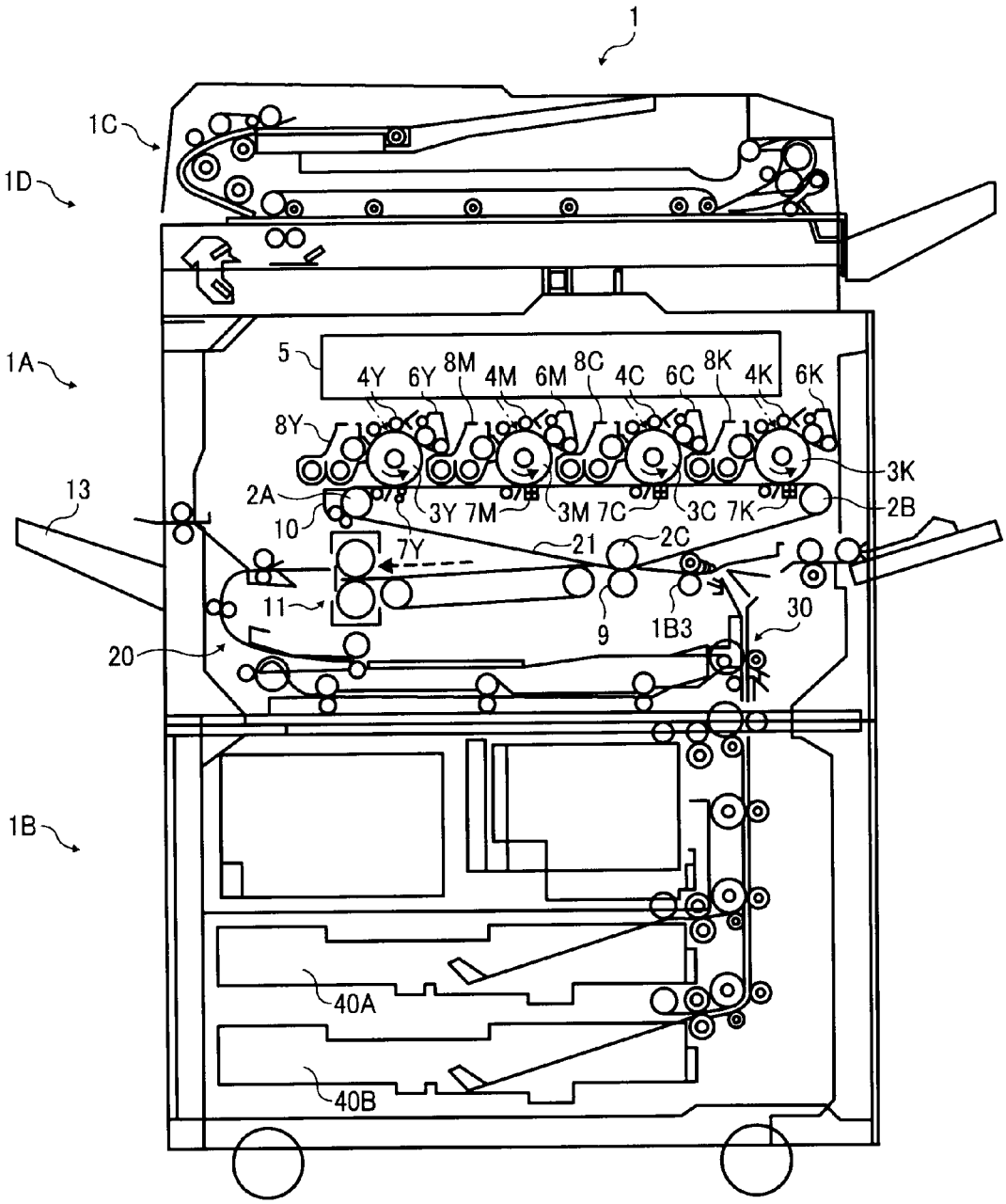
FIG. 1 is a cross-sectional view of an image forming apparatus according to an embodiment of the present invention.

FIG. 1 is a cross-sectional view of an image forming apparatus according to an embodiment of the present invention, one example of which is a tandem-type full-color copier. It is to be noted that the structure described herein is an example, and the apparatus is not limited thereto. For example, the image forming apparatus according to the present embodiment may be not only a full-color copier but also a printer, a facsimile machine, or a multi-functional apparatus including at least two capabilities of the above devices.

As illustrated in FIG. 1, an image forming apparatus 1 mainly includes an image forming unit 1A, a sheet feeder unit 1B disposed below the image forming unit 1A, a scanner 1D including an automatic document feeder (ADF) 1C disposed above the image forming unit 1A.

The image forming unit 1A includes an intermediate transfer belt 21, which is an intermediate transfer member with a transfer surface extending in the horizontal direction. The intermediate transfer belt 21 is an endless belt stretched over a plurality of rollers 2A, 2B, and 2C. Above the intermediate transfer belt 21, photoreceptors 3Y, 3M, 3C, and 3K as image carriers capable of carrying the toner image of the complementary colors of yellow, magenta, cyan, and black are disposed along the transfer surface of the intermediate transfer belt 21. These photoreceptors 3Y, 3M, 3C, and 3K each are formed in a drum shape and are rotatable in the same direction (i.e., counterclockwise). Around each photoreceptor, image forming parts and components are arranged, that is, a charger 4Y, 4M, 4C, or 4C, a writing and exposure unit 5 as an optical writing member, a developing device 8Y, 8M, 8C, or 8K, a cleaning unit 6Y, 6M, 6C, and 6K, and the like are disposed. In addition, primary transfer rollers 7Y, 7M, 7C, and 7K each are disposed opposite each of the photoreceptors 3Y, 3M, 3C, and 3K, with the intermediate transfer belt sandwiched in between. Each of the primary transfer rollers 7Y, 7M, 7C, and 7K together with each of the photoreceptors 3Y, 3M, 3C, and 3K forms a primary transfer nip. The suffixes of Y, M, C, and K represent colors of the toner. The part or component to which these suffixes are attached is the same part or component except for the color of the toner. Therefore, the suffixes of Y, M, C, and K are omitted as appropriate in the following description. (In addition, a sequential order of the part or component to which these suffixes are attached is not limited to the illustrated example in FIG. 1.)

Each developing device 8 contains color toner corresponding to respective toner color. The intermediate transfer belt 21 is an endless belt wound over a drive roller 2B and driven rollers 2A and 2C. The driven rollers 2A and 2C rotatably move when the drive roller 2B rotatably drives, in the direction accompanied by the drive roller 2B. The intermediate transfer belt 21 rotatably moves at positions opposite the photoreceptors 3Y, 3M, 3C, and 3K clockwise in FIG. 1. In addition, a cleaning unit 10 to clean the surface of the intermediate transfer belt 21 is disposed at a position opposite the driven roller 2A with the intermediate transfer belt sandwiched in between.

Next, image forming operation in the thus configured image forming apparatus will now be described. As illustrated in FIG. 1, the scanner 1D in the image forming apparatus 1 serves to read an image in the original to form an image to be reproduced. This scanner is a known type of scanner which optically scans the original image on the scanning surface. The scanner 1D according to the present embodiment includes an ADF 1C to convey the original on the platen, but may be a type of the feeder the user manually places to set an original on the platen.

Subsequently, the above photoreceptor 3 is driven to rotate counterclockwise by a drive source, not shown in the figure. This time, light from an electrical discharger irradiates the surface of the photoreceptor 3, thereby initializing the surface potential of the photoreceptor 3. The surface of the photoreceptor 3 of which the surface potential thus initialized is then uniformly charged to a predetermined polarity. A laser beam from the exposure unit 5 corresponding to an image scanned by the scanner 1D irradiates the charged surface of the photoreceptor 3, whereby an electrostatic latent image is formed on the surface of the photoreceptor 3. The image information exposed on each of the photoreceptors is the image information of a single color separated into each toner color information of yellow, cyan, magenta, and black separated from the full-color image scanned by the scanner 1D. The electrostatic latent image formed on the photoreceptor 3 is visualized to be a visual image by being applied with each color toner from the developing device 8 while the photoreceptor 3 passing through the developing device 8.

In addition, while the intermediate transfer belt 21 is being driven to move clockwise in FIG. 1, the primary transfer roller 7 is applied with a primary transfer voltage with a polarity contrary to the polarity of the charged toner of the toner image formed on the photoreceptor 3. With this structure, a transfer electric field is formed between the photoreceptor 3 and the intermediate transfer belt 21 and the toner image on the photoreceptor 3 is primarily transferred to the intermediate transfer belt 21 which is driven to rotate in sync with the photoreceptor 3. Thus, the primarily transferred color toner image is superimposed one after another on the intermediate transfer belt 21 at an appropriate timing from upstream in the conveyance direction of the intermediate transfer belt 21, thereby forming a desired full-color toner image on the intermediate transfer belt 21. The residual toner remaining on the photoreceptor 3 after the primary transfer is removed and collected by the cleaning unit 6 and the surface of the photoreceptor 3 after being cleaned is electrically discharged by a discharge lamp and is initialized, and becomes ready for a subsequent image formation.

On the other hand, a sheet P as a recording medium on which an image is to be formed is conveyed by being fed one by one by appropriately disposed sheet feed roller as a conveyance means from a sheet bundle stacked on the sheet feed tray 40A or 40B to a registration roller pair 30. The sheet feed unit 1B, including sheet feed trays 40A and 40B and sheet feed rollers, is configured to convey the sheet P one by one stacked on the sheet feed trays 40A and 40B toward the image forming unit 1A. A leading end of the sheet P conveyed up to the registration roller pair 30 enters a nip portion formed by the registration roller pair 30 which does not start rotation. At this time, by forming a so-called loop, registration of the sheet P, that is, an oblique slip correction is performed. Thereafter, at an appropriate timing with the full-color toner image carried on the intermediate transfer belt 21, rotation driving of the registration roller pair 30 starts. The sheet P is conveyed toward a secondary transfer nip formed by the opposed roller 2C being one of the support rollers wound over the intermediate transfer belt 21 and a secondary transfer roller 9 opposite the opposed roller 2C via the intermediate transfer belt 21. The sheet feed unit 1B further includes another registration roller pair 1B3 to convey the sheet P once halted and corrects its oblique slip when the leading end of the image on the intermediate transfer belt 21 is in sync with the sheet P in the conveyance direction. Upstream of the registration roller pair 1B3, a sensor to detect a reflectivity of the surface of the sheet is disposed, and when the reflectivity of the sheet surface is different from the sensor output in the previous section, the intermediate transfer belt 21 or the opposed roller 2C is switched.

In the present embodiment, the opposed roller 2C disposed opposite the secondary transfer roller 9 is applied with transfer voltage with the same polarity as that of the charged toner of the toner image on the surface of the intermediate transfer belt 21. Accordingly, the full-color toner image formed on the intermediate transfer belt 21 is en block transferred to the sheet P. A known fixing device 11 includes a fixing roller and a pressure roller. The sheet P on which the toner image has been transferred is then conveyed to the fixing device 11, and when passing through the fixing device 11, the toner image is quasi-eternally fixed onto the sheet P by the effect of heat and pressure exerted by the fixing roller and the pressure roller of the fixing device 11. The sheet P on which the image has been transferred after the fixing process is discharged to for example a discharge tray 13 and the image forming operation terminates. The residual toner after the secondary transfer remaining on the intermediate transfer belt 21 without being used for image transfer to the recording medium in the secondary transfer portion in which the secondary transfer roller 9 and the opposed roller 2C are disposed is removed and collected by the cleaning unit 10 for the intermediate transfer belt 21.

Although not necessary for the structure of the image forming apparatus according to the present embodiment, the image forming apparatus 1 includes a known reverse conveyance path 20 to convey the sheet P of which the surface is reversed upside down.

Herein, an exemplary configuration of the primary transfer section will be described in more detail.

The primary transfer roller 7 is pressed, from a backside surface of the intermediate transfer belt 21, at a predetermined pressure by a shaft bearing and a compression spring against the photoreceptor 3 via the intermediate transfer belt 21, that is, with the intermediate transfer belt 21 interposed between the primary transfer roller 7 and the photoreceptor 3. The primary transfer roller 7 is rotated by the rotation of the intermediate transfer belt 21. A contact position between the primary transfer roller 7 and the intermediate transfer belt 21 is offset by substantially 1 to 2 mm downstream in the rotary driving direction of the intermediate transfer belt 21 relative to a center position of the photoreceptor 3. Further, the primary transfer roller 7 includes a metal core and a rubber material having medium electric resistivity (for example, foamed rubber with medium resistivity) wound over the metal core. The preferred volume resistivity of the rubber material is from $10^6$ to $10^{10}$ Ω/cm, and more preferably from $10^7$ to $10^9$ Ω/cm. The material is not limited to the foamed rubber, but a solid rubber with medium resistivity may also be used. In the primary transfer process as illustrated herein, the primary transfer bias is applied to the primary transfer roller 7 from a rated current source having a positive polarity and the set current amount is from 20 to 40 μA.

An exemplary configuration of the secondary transfer portion will be described in more detail. The opposed roller 2C for the secondary transfer includes a metal core and a rubber material with medium resistivity wound over the metal core. As an exemplary embodiment, the opposed roller 2C includes solid rubber with medium resistivity of which the volume resistivity is from $10^6$ to $10^{10}$ Ω/cm, and more preferably from $10^7$ to $10^9$ Ω/cm. Further, the secondary transfer roller 9 includes a foamed rubber with the volume resistivity of from $10^6$ to $10^{10}$ Ω/cm, and preferably from $10^7$ to $10^9$ Ω/cm.

In the secondary transfer process in the embodiment of the present invention, the opposed roller 2C is applied with a bias of the same negative polarity as that of the toner. A constant current power supply source is used as a power supply source and the set current amount is substantially from 30 to 50 μA. Owing to the effect of the constant current power supply, the secondary transfer field is applied such that the negative polarity toner on the intermediate transfer belt 21 is pushed toward the recording medium with the secondary transfer roller 9 connected to the earth ground as an opposite side.

Specific materials of the intermediate transfer belt 21 according to the present embodiment formed of a single-layered belt include polyimide (PI), polyamideimide (PAI), polycarbonate (PC), ethylene-tetrafluoroethylene (ETFE), polyvinylidene fluoride (PVDF), polyphenylene sulfide (PPS), and the like, of which the resistivity is adjusted by dispersing carbon material or ion conductive agent to form a medium resistivity resin. The volume resistivity of the thus-formed resin ranges from $10^6$ to $10^{10}$ Ω/cm, and preferably from $10^7$ to $10^9$ Ω/cm, and the surface resistivity thereof is from $10^6$ to $10^{12}$ Ω/cm$^2$, and preferably from $10^8$ to $10^{12}$ Ω/cm$^2$. In addition, the thickness thereof is from 50 to 100

μm. Its Young's modulus is preferably 300 Mpa or more and satisfactory mechanical strength against bending, cripples, and waving is required.

The intermediate transfer belt 21 may further include, on the surface side of the single-layered structure of the medium resistivity resin as formed above, a surface layer with a slightly higher volume resistivity than the belt itself. The add-on surface layer has a thickness of 1 to 10 μm. Use of such an intermediate transfer belt may decrease occurrence of abnormal image which the user calls "white dots." The white dots occur in particular to a type of the belt which controls the resistivity by dispersing carbon particles in the resin material, and the phenomenon occurs as follows. When the sheet is subjected to the fixing process and moisture of the sheet decreases and the resistivity of that part increases, the white dots appear to that type of sheet. A passage in which transfer current flows intensively is generated due to the variation in the dispersed state of carbon particles, and the toner on that passage is scattered to cause white omissions to occur. By disposing a high resistivity layer on the surface of the belt, a local concentration of the transfer current is moderated and the phenomenon of abnormal image (so-called white dots) can be eliminated.

Further, according to another embodiment of the intermediate transfer belt 21, on a base layer with a thickness of from 50 to 100 μm formed of materials such as PI, PAI, PC, ETFE, PVDF, PPS and the like by dispersing carbon material or blending ion conductive agent to thus form a medium resistivity resin of which resistivity is adjusted, an elastic layer of from 100 to 500 μm formed of a rubber material such as urethane, NBR or nitrile butadiene rubber, CR or chloroprene rubber, and the like by dispersing carbon material or by blending ion conductive agent of which resistivity is adjusted is disposed. Further, on the surface layer, coating of a fluorine system rubber or resin (or hybrid material thereof) with a thickness of from 1 to 10 μm is applied. Further, a multi-layered belt added with fine particles on its surface thereof to suppress sticking of the elastic material can be used. With such a structure, when the intermediate transfer belt 21 is formed in a multi-layered form and at least one layer among the plurality of layers is formed by any elastic material (that is, an elastic intermediate transfer belt is used), toner transferability to the so-called embossed sheet with a low fibrous density or with concavity and convexity of from 50 to 200 μm on its surface is optimal because solid coating effect can be obtained.

Figure 2:
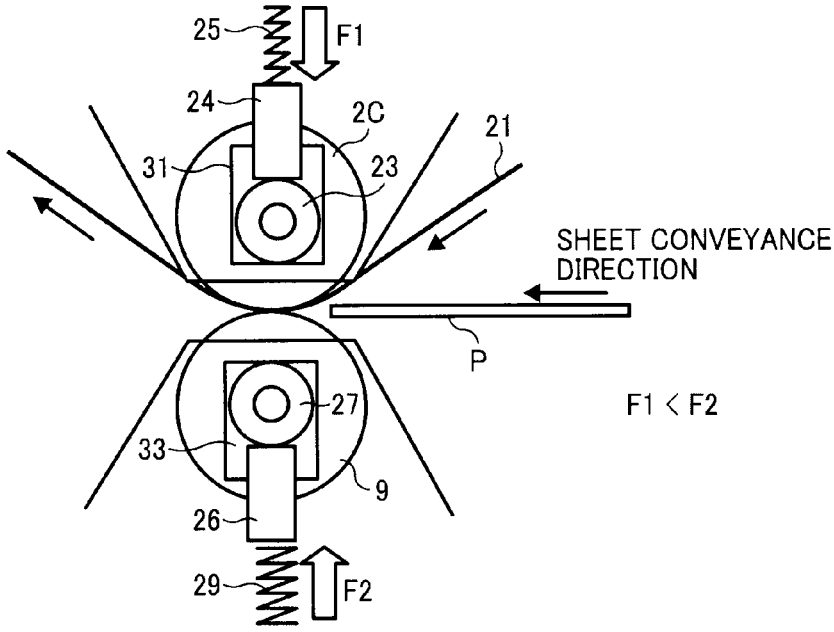
FIG. 2 is a cross-sectional view of a secondary transfer nip portion in the image forming apparatus in FIG. 1, showing a state immediately before a recording medium enters the secondary transfer nip portion.
Figure 3:
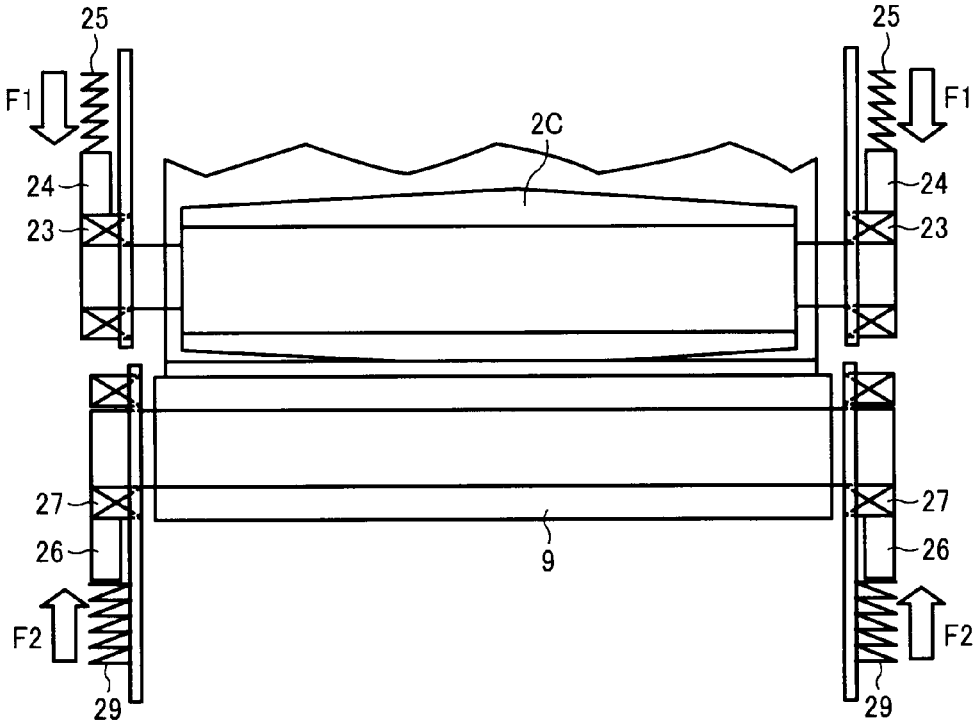
FIG. 3 is a side view of the secondary transfer nip portion in FIG. 2 seen from a conveyance direction of the recording medium.

Next, the secondary transfer nip portion will be described with reference to FIGS. 2 to 5. FIG. 2 is a cross-sectional view of a secondary transfer nip portion in the image forming apparatus in FIG. 1, and shows a state immediately before a recording medium enters the secondary transfer nip portion. FIG. 3 is a side view corresponding to the cross-sectional view in FIG. 2 seen from the conveyance direction of the recording medium.

As illustrated in FIGS. 2 and 3, the secondary transfer nip according to the present embodiment is configured such that the opposed roller 2C and the secondary transfer roller 9 sandwiches the intermediate transfer belt 21 moving from right to left with a predetermined nip pressure. Herein, the opposed roller 2C formed as a repulsive force roller is rotatably supported by a bearing 23 at both its lateral ends. The bearing 23 receives biasing force of a biasing element. In the present embodiment, the biasing element is a pressure spring 25, which biases the bearing 23 via a pressing member 24 and is pressed downwards. This bearing 23 is fit in a bearing guide 31 formed in the roller 2C so as to be vertically movable along the bearing guide 31.

In a state in which the sheet P does not reach the secondary transfer nip yet as illustrated in FIG. 2, the bearing 23 contacts a bottom wall of the bearing guide 31 which does not allow the bearing 23 to move downwards anymore and in this state the secondary transfer nip sandwiched by the secondary transfer roller 9 and the intermediate transfer belt 21 is properly formed. In this secondary transfer nip, the biasing force applied to the opposed roller 2C by the pressure spring 25 is a pressure F1.

Similarly, the secondary transfer roller 9 is rotatably supported by a bearing 27 at its lateral end portions. The bearing 27 receives biasing force of the pressure spring 29 via a pressing member 26 and is pressed upwards. This bearing 27 is fit in a bearing guide 33 formed in the secondary transfer roller 9 so as to be vertically movable along the side wall of the bearing guide 33. In a state in which the sheet P does not reach the secondary transfer nip yet as illustrated in FIG. 2, the bearing 27 contacts an upper wall of the bearing guide 33 so as not to move upwards anymore and in this state the secondary transfer nip sandwiched by the opposed roller 2C and the intermediate transfer bet 21 is properly formed. In this secondary transfer nip, the biasing force applied to the secondary transfer roller 9 by the pressure spring 29 is a pressure F2. Accordingly, the nip pressure in the secondary transfer nip is equal to a total of the pressures F1 and F2. In this example, the biasing forces of the pressure springs 29 and 25 are so adjusted that the pressure F2 is greater than the pressure F1.

Figure 4:
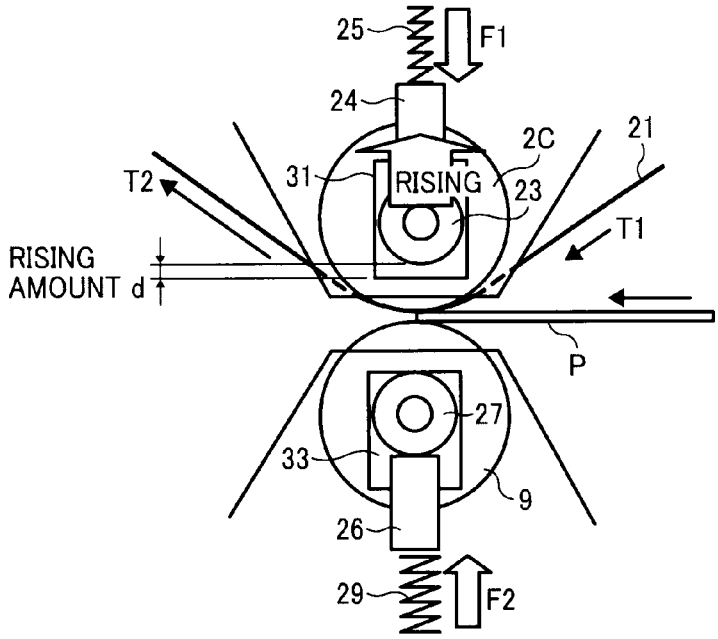
FIG. 4 is a cross-sectional view of the secondary transfer nip portion in the image forming apparatus according to an embodiment of the present invention, showing a state in which the recording medium enters the secondary transfer nip portion.

FIG. 4 is a cross-sectional view of the thus-configured secondary transfer nip into which the sheet P as a recording medium is conveyed. When the sheet P enters the secondary transfer nip, the opposed roller 2C and the secondary transfer roller 9 both receive a force to separate from each other by the thickness of the sheet. As illustrated in FIG. 4, because the pressure F2 is greater than the pressure F1, when the sheet P enters the secondary transfer nip as illustrated, the opposed roller 2C moves upwards by a rising amount d which corresponds to the thickness of the sheet P.

In the background art, because the opposed roller 2C is fixed to the image forming apparatus, when the sheet P enters the secondary transfer nip as illustrated in FIG. 4, the secondary transfer roller 9 moves downwards so that the sheet P passes through the secondary transfer nip. In this case, however, a temporary load change is applied to the intermediate transfer belt 21, that is, a brake to prevent the intermediate transfer belt 21 from rotating is applied. Thus, the load to the intermediate transfer belt 21 changes in a direction in which tension T1 at a side of the entrance of the sheet P into the secondary transfer nip is loosened and tension T2 at a side of the exit of the sheet P from the secondary transfer nip is strengthened so as to be stretched. The torque load change occurs in particular when the sheet P is a thick sheet. The increase of the tension T2 at the exit side of the sheet P from the secondary transfer nip causes a change in the speed of the intermediate transfer belt 21 and this fluctuation in speed is transmitted to the primary nip disposed downstream of the rotary driving direction of the intermediate transfer belt 21. Then, when image formation on a plurality of sheets is performed, a toner image under the primary transfer process disposed downstream of the currently formed image in the secondary transfer process receives an adverse effect of shock jitter.

By contrast, in the embodiment of the present invention, because the opposed roller 2C opposite the secondary transfer roller 9 moves upwards when the sheet P enters the secondary transfer nip, the increase of the tension T1 at the exit side from the secondary transfer nip is cancelled as the opposed roller 2C rises. As a result, the shock jitter at the primary transfer nip can be moderated.

In addition, because the opposed roller 2C and the secondary transfer roller 9 are biased in a direction to form the secondary transfer nip, that is, toward the roller center of each other, a great nip pressure can be achieved and the nip pressure is constantly given to the secondary transfer nip from the both rollers 2C and 9. Therefore, even though the sheet P may be a recording medium with substantial surface asperities, transfer performance is not degraded.

Accordingly, the structure of the present embodiment reduces shock jitter occurring when a thick sheet is passed through the nip even under the high contact pressure needed to provide good image transfer.

Figure 5:
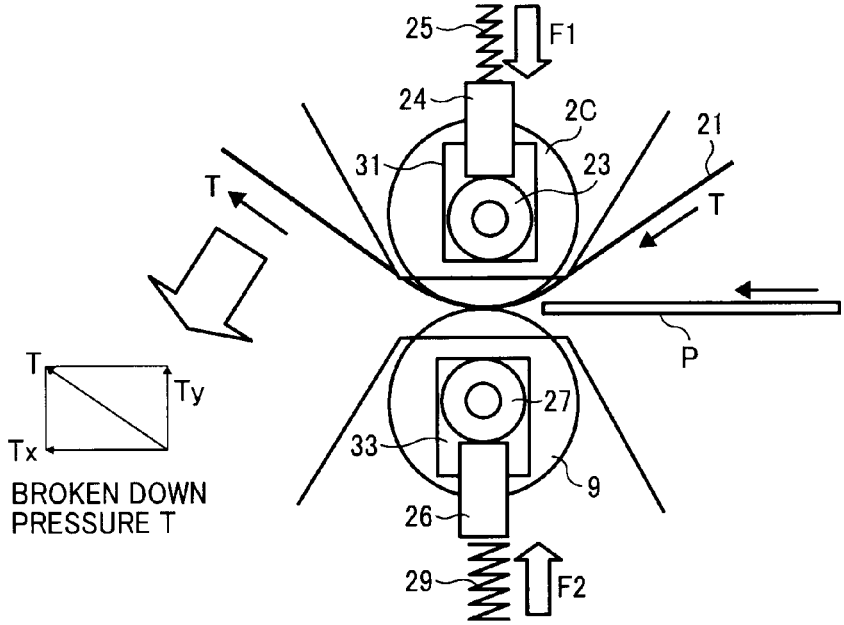
FIG. 5 is a view illustrating a relation between tension of the intermediate transfer member and a biasing force applied by a biasing member to an opposed roller in the secondary transfer nip of the image forming apparatus according to an embodiment of the present invention.

FIG. 5 is a view illustrating a relation between the tension T of the intermediate transfer belt 21 and a biasing force applied by the pressure spring 25 of the opposed roller 2C in the secondary transfer nip of the image forming apparatus according to the embodiment of the present invention. The intermediate transfer belt 21 is stretched or wound over a plurality of rollers to have a predetermined tension T (by using a tension roller or by its own stretchability). In the present embodiment, the opposed roller 2C is one of the rollers over which the intermediate transfer belt 21 is wound and is movably disposed. Therefore, when the relation between the tension T of the intermediate transfer belt 21 and the pressure force F1 of the pressure spring 25 configured to apply the biasing force to the opposed roller 2C to press against the secondary transfer roller 9 is inadequate, the secondary transfer nip is not properly formed.

As illustrated in FIG. 5, the tension T can be broken down into a tensile force component Ty coping with the biasing force in the improper direction of the pressure spring 25 and a tensile force component Tx. When the tensile force component Ty is greater than the biasing force of the pressure spring 25 of the opposed roller 2C, the opposed roller 2C may be displaced away from the secondary transfer nip. Therefore, in the present embodiment, the tensile force component Ty is adequately adjusted to be less than the pressure force F1, that is, so that the opposed roller 2C is raised upwards only when the recording medium is passed through the secondary transfer nip.

Figure 6:
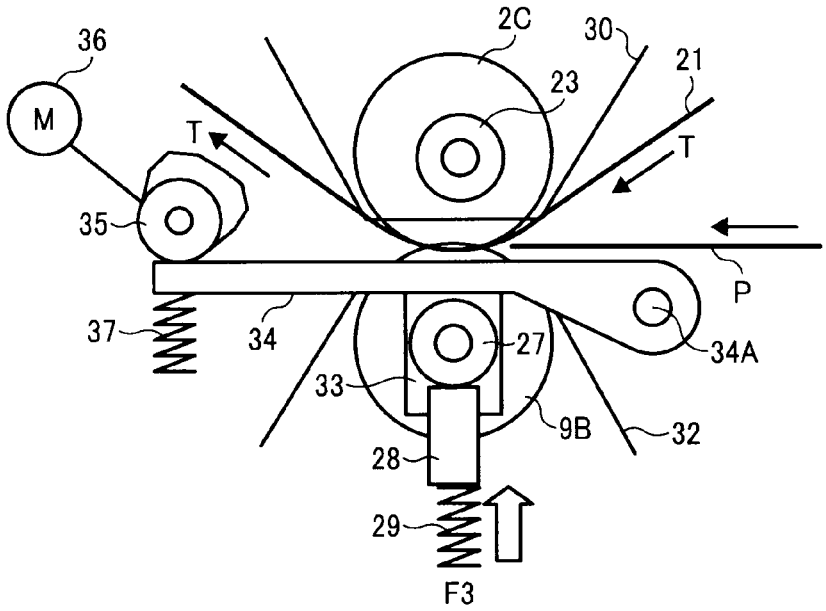
FIG. 6 is a detailed view illustrating an intermediate transfer member and a secondary transfer portion according another embodiment of the present invention.
Figure 7:
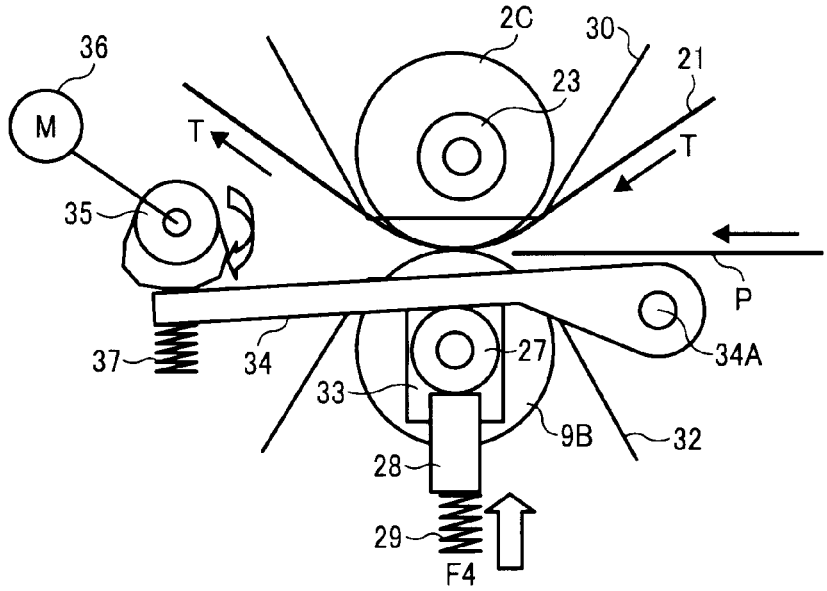
FIG. 7 shows a state immediately before the thick sheet enters the secondary transfer nip portion in a thick sheet mode.
Figure 8:
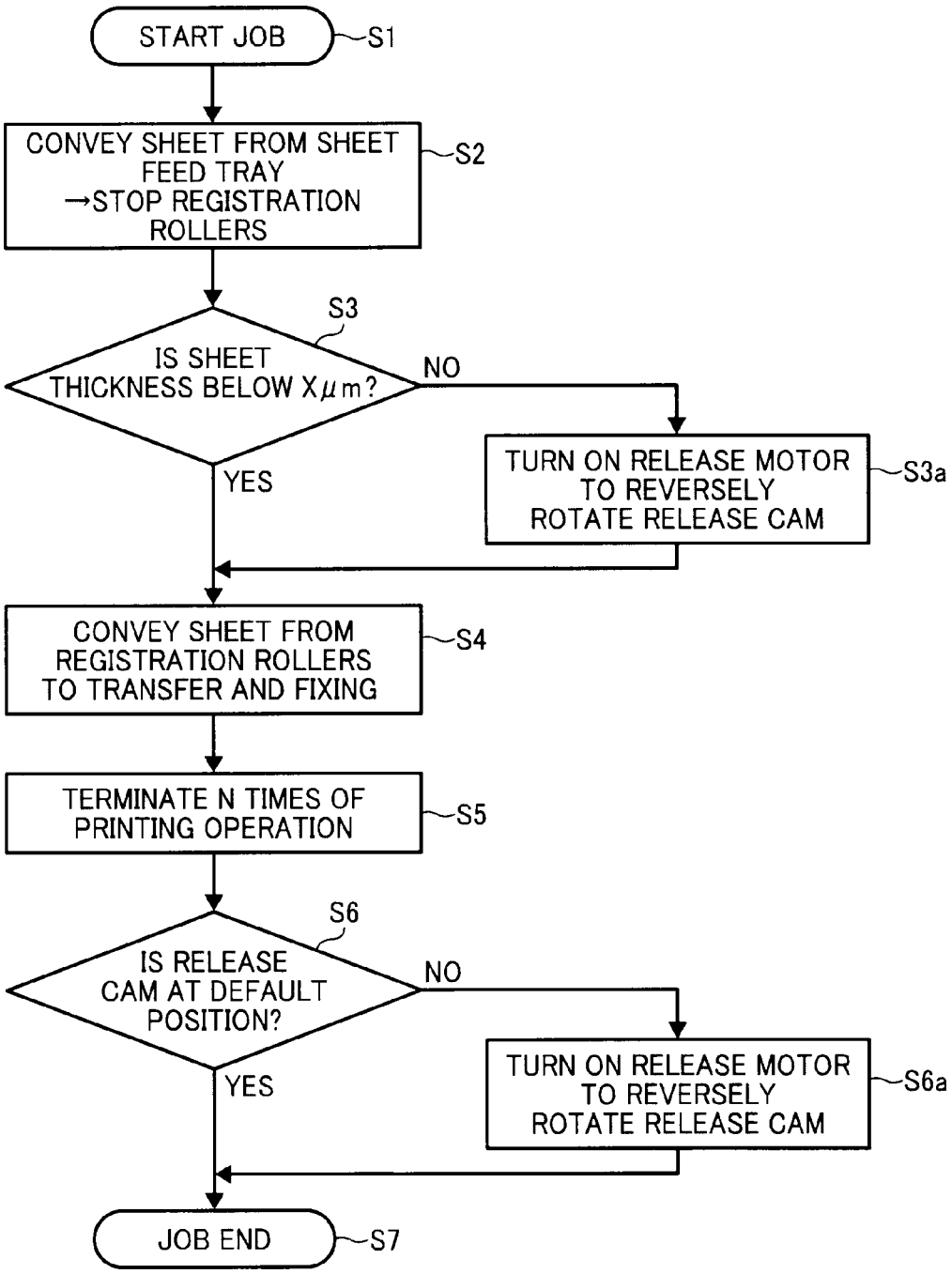
FIG. 8 is a flowchart illustrating operation of the image forming apparatus according to an embodiment of the present invention.

Referring now to FIGS. 6 to 8, another embodiment of the present invention will be described. FIG. 6 is a detailed view illustrating an intermediate transfer member and a secondary transfer portion according another embodiment of the present invention. Similarly to the case of the first embodiment, the present secondary transfer device and the intermediate transfer member are configured to have a higher pressure to secure optimal toner transferability even in a case of high-asperity recording media and increased thickness (a so-called embossed sheet), and further can provide an optimal image without shock jitter even with use of a thick sheet.

FIG. 6 shows a front view of the secondary transfer portion illustrating a state in which the transfer sheet P (herein, a normal sheet) enters into the secondary transfer portion in a normal sheet mode. The opposed roller 2C serving as a repulsive force roller is roller-shaped and has the same electrical polarity as that of the load of the toner.

The opposed roller 2C is rotatably supported at its lateral ends by the bearing 23 fixed to an inner rotary side plate 30. By contrast, a secondary transfer roller 9B is rotatably support by the bearing 27 at its lateral ends and can vertically move along the side wall of the bearing guide 33 together with the bearing 27. The secondary transfer roller 9B moves along a line connecting a center of the opposed roller 2C and a center of the secondary transfer roller 9B. When the sheet P is not conveyed, the secondary transfer roller 9B is pressed against the opposed roller 2C at a load F3 due to the biasing force of the pressure spring 29. Due to the rubber deformation of both rollers, a predetermined nip width and pressure are formed between the rollers.

In the normal sheet mode, a release lever 34 is pushed upwards by a push-up spring 37. A release cam 35 is positioned as illustrated in FIG. 6 and the release lever 34 and the bearing 27 do not contact each other. Normally, when the normal sheet or a tissue paper enters into the secondary transfer nip, because the sheet is thin and not very stiff such a sheet is conveyed substantially along the shape of the nip formed between the roller pair, the relative position of the secondary transfer roller 9B does not change much, and the load change against the opposed roller 2C and the intermediate transfer belt 21 is small. Therefore, the shock jitter in the primary transfer portion is within a permissible range.

The release lever 34 includes as a rotary support thereof a shaft 34*a* at its base end section. The front end of the release lever 34 which receives a rotary driving force by the shaft 34*a*, the release cam 35, and the push-up spring 37 is disposed at an opposite position, with the secondary transfer nip formed between the opposed roller 2C and the secondary transfer roller 9B sandwiched in the conveyance direction of the sheet P. More specifically, the shaft 34*a* is positioned upstream of the secondary transfer nip in the sheet conveyance direction and the release cam 35 and the push-up spring 37 receiving a rotary driving force at the front end side are disposed downstream.

On the other hand, from a state as illustrated in FIG. 6, upon a leading end of a thick sheet entering into the secondary transfer nip, the secondary transfer roller 9B moves in a direction separating from the opposed roller 2C by a distance substantially corresponding to a thickness of the thick sheet. The thick sheet having a greater thickness and stiffness causes the shape of the nip formed by the roller pair to be substantially horizontal, and therefore, the secondary transfer roller 9B largely moves to separate from the opposed roller 2C.

As a result, the force of the secondary transfer roller 9B pressing the opposed roller 2C changes and the repulsive force due to the move of the secondary transfer roller 9B causes load change against the opposed roller 2C to occur. Then, the intermediate transfer belt 21 receives a brake to change in speed in the direction opposite the conveyance direction, which causes image shift in the primary transfer portion, that is, the shock jitter as an abnormal image.

FIG. 7 shows a state immediately before the thick sheet enters the secondary transfer nip portion in the thick sheet mode.

When a sensor, not shown, configured to detect thickness of the sheet detects that the detected thickness exceeds a predetermined threshold value, the release motor 36 drives to rotate the release cam 35 which lowers the release lever 34 downwards before the sheet P passes through the secondary transfer portion, causing the bearing 27 which supports the secondary transfer roller 9B moves downwards in a direction separating from the opposed roller 2C immediately before the sheet passes. Then, because the secondary transfer roller 9B is at a final position when the thick sheet passes through the secondary transfer nip portion, neither the load change nor the fluctuation in speed to the opposed roller 2C which may cause the intermediate transfer belt 21 to be braked occurs, thereby drastically reducing the shock jitter due to the entrance of the thick sheet into the secondary transfer nip.

FIG. 8 is a flowchart show steps in the process described above. When the image forming operation starts (in step S1), the sheet P is conveyed from the sheet feed tray to the registration roller pair 1B3 (in step S2), and a thickness of the sheet P is detected (in step S3). When the sheet thickness is not below a predetermined Xμm, the release motor 36 is turned on to cause the release cam 35 to be reversely rotated (in step S3*a*). When the sheet thickness is below the predetermined Xμm, the sheet is conveyed from the registration roller to the secondary transfer roller 8B and to the fixing device 11 (in step S4). After a predetermined N times of printing operation is repeatedly performed, the repeated operation is terminated (in step S5). Then, it is detected whether the release cam 35 returns to the default position (in step S6). When the release cam 35 does not return to the default position, the release motor 36 is turned on to reversely rotate the release cam 35 (in step S6*a*) to return to the release cam 35 to the default position to end the job (JOB END) (in step S7). If in step S6 the release cam 35 returns to the default position, the job also ends (in step S7).

The preferred embodiments described heretofore include a structure in which the secondary nip is horizontally formed so that the secondary transfer roller 9 and the opposed roller 2C are configured to move vertically. Alternatively, however, the secondary transfer nip may be formed obliquely and the secondary transfer roller 9 or 9B and the opposed roller 2C can be moved obliquely. In short, the secondary transfer roller 9 or 9B and the opposed roller 2C each are preferably movable along the line connecting respective centers.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an endless intermediate transfer member stretched over a plurality of rotatably driven rollers and configured to bear a toner image on a surface thereof;

a first biasing member;

a secondary transfer roller to be pressed against the surface of the intermediate transfer member by the first biasing member at a pressure F2;

an opposed roller, being one of the plurality of rollers around which the intermediate transfer member is wound, disposed opposite the secondary transfer roller with the intermediate transfer member sandwiched between the opposed roller and the secondary transfer roller, the secondary transfer roller and the opposed roller together forming a secondary transfer nip with the sandwiched intermediate transfer member, at which the toner image carried on the intermediate transfer member is transferred onto a recording medium; and a second biasing member to bias the opposed roller toward a center of the secondary transfer roller at a pressure F1, wherein the opposed roller moves upwards along a line connecting respective axes of the secondary transfer roller and the opposed roller when the recording medium enters the secondary transfer nip, and the pressure F2 applied by the first biasing member to the secondary transfer roller at the secondary transfer nip is greater than a pressure F1 applied to the opposed roller by the second biasing member at the secondary transfer nip.

2. The image forming apparatus as claimed in claim 1, wherein the pressure F1 applied to the opposed roller at the secondary transfer nip offsets a tension T of the intermediate transfer member at the secondary transfer nip.

3. The image forming apparatus as claimed in claim 1, wherein the intermediate transfer member is formed of a plurality of layers, at least one of which is formed of elastic material.

4. The image forming apparatus as claimed in claim 1, wherein the opposed roller moves upwards by an amount corresponding to a thickness of the recording medium.

5. An image forming apparatus comprising:

a photoreceptor to bear a developed toner image on a surface thereof;

an intermediate transfer member to electrostatically receive the developed toner image thereon from the photoreceptor;

a secondary transfer member to electrostatically transfer the toner image onto a transfer sheet, the secondary transfer member being disposed opposite the intermediate transfer member via the transfer sheet;

an opposed member disposed opposite the secondary transfer member via the intermediate transfer member and the transfer sheet;

a pressing member to press the secondary transfer member against the opposed member;

a sheet sensor to detect a thickness of the transfer sheet; and a positioning unit that adjusts a distance between the secondary transfer member and the opposed member based on a thickness of the transfer sheet passing therebetween as detected by the sheet sensor, the positioning unit including a rotatable arm member which moves the secondary transfer member against the pressing member and away from the opposed member, and a driving member which rotates the arm member, wherein the secondary transfer member moves toward the opposed member along a line connecting respective axes of the secondary transfer member and the opposed member, and wherein a first side of the arm member presses against the pressing member and the driving member abuts a second side of the arm member.

6. The image forming apparatus as claimed in claim 5, wherein the positioning unit sets a minimum distance between respective axes of the secondary transfer member and the opposed member according to the sheet thickness detected by the sheet sensor.

7. The image forming apparatus as claimed in claim 5, wherein the arm member comprises a rotary support shaft and a rotary driving force receiving member disposed opposite each other with the secondary nip formed by the opposed roller and the secondary transfer member disposed therebetween in the transfer sheet conveyance direction.

8. The image forming apparatus as claimed in claim 7, wherein the support shaft of the arm member is disposed upstream of the secondary transfer nip formed by the opposed roller and the secondary transfer member in the transfer sheet conveyance direction.

9. The image forming apparatus as claimed in claim 7, wherein the rotary support shaft is provided at a first end of the arm member, and the rotary driving force receiving member is provided at a second end of the arm member, and wherein the driving member abuts the rotary driving force receiving member.

10. The image forming apparatus as claimed in claim 9, wherein a biasing member is provided on a side of the rotary driving force receiving member opposite a side which abuts the driving member.

* * * * *